United States Patent [19]

Bischoff, Jr.

[11] 3,977,803

[45] Aug. 31, 1976

[54] PROCESS FOR DEVELOPING SURFACES

[76] Inventor: Robert F. Bischoff, Jr., 30 Fairmount Ave., Morristown, N.J. 07960

[22] Filed: Dec. 11, 1974

[21] Appl. No.: 531,467

[52] U.S. Cl. ..... 404/72; 404/70

[51] Int. Cl.[2] ..... E01C 3/06

[58] Field of Search ..... 404/136, 72, 135, 134, 404/70; 52/364, 363, 677, 678, 679, 680–689

[56] References Cited

UNITED STATES PATENTS

| | | | |
|---|---|---|---|
| 1,672,852 | 6/1928 | Roughan | 404/136 X |
| 1,809,870 | 6/1931 | Smith | 404/136 X |
| 2,031,265 | 2/1936 | Keseling | 404/136 |
| 2,064,705 | 12/1936 | Whitehead | 404/136 X |
| 2,262,704 | 11/1941 | Tompkins | 52/365 X |
| 3,115,726 | 12/1963 | Sayles | 404/136 X |
| 3,390,500 | 7/1968 | Schumak | 52/365 |
| 3,397,494 | 8/1968 | Waring | 52/365 X |
| 3,447,279 | 6/1969 | Martens | 52/365 X |

*Primary Examiner*—Nile C. Byers, Jr.

[57] ABSTRACT

A process for developing surfaces to determined elevations upon sound surfaces, whether or not these said sound surfaces are level or regular, said development to be done by the use of pre-set points and pre-set screeds, used either alone or in conjunction with one another, formed upon the said sound surfaces, which pre-set points and pre-set screeds become part of the new surfaces being developed.

3 Claims, No Drawings

PROCESS FOR DEVELOPING SURFACES

A sound surface of cement or other completely packed solid will have laid upon it a new module to be formed by the pouring of cement, concrete, or other types of material.

In order to construct the said new module, the elevations of the new module must be determined. Those familiar with the art of pouring cement, concrete, or other similar types of material, know that the use of screeds, whose tops are of predetermined elevations, is one means whereby the said determined elevations of the new slab may be obtained.

This new process for developing surfaces entails the use of pre-set screeds and points for the surfacing or resurfacing of an already existing sound surface, which said sound surface is to be elevated to specified heights. The said existing sound surface may or may not be level or regular regarding its existing elevation.

The said existing sound surface will have a new module placed on it to level or smooth it, or in order to elevate, position, or reposition it, or for any combination of these reasons.

The first step in the process for developing surfaces is to form upon the existing sound surface a group of pre-set points, which said points can be used as reference points for the construction of the pre-set screeds. These points are formed at designated spots, said designated spots to be those positions judged best suited for the construction of the pre-set screeds by the controller of the invented surfacing process.

The said points are then elevated to particular heights, which said heights are determined by the desired final elevations of the new module to be laid. The said determined elevations of the said points are obtained accurately through the use of a surveyor's land level.

The said points are built by using globs of cement, concrete or other similar types of material, to form mounds. The said globs are made of a normal mix of the said materials, preferably with a consistency such that said mix forms quickly once it has been placed in position. The points are then formed by using globs of the said mix to make mounds. The globs should be of a suitable quantity of the mix to form a mound slightly higher than the predetermined elevations of the entire new module to be laid. The said mound is then formed and padded to the desired elevation as obtained by the surveyor's land level mentioned previously to elevate a point, said forming and padding being done after the mound has had a chance to slightly set or form, but before the mix forming the point has hardened beyond workability of the cement. It is understood that the mound when completed is in the form of a cone frustum because the padding is done from the top down, thus leaving an upper base diameter of approximately two inches or larger, thereby giving sufficient surface area on which to mount the leveling stick.

These mounds then establish points, which said points are used as guidelines for the construction of the pre-set screeds. The said points are so distanced from each other so as to allow a leveling stick to be simultaneously placed on top of at least two of them, which leveling stick will then determine a height for the formation of at least one pre-set screed.

The second step in the process is the construction of the pre-set screeds, which said screeds are constructed of the same mix which has formed the point mounds.

These pre-set screeds are then constructed under the leveling stick. The pre-set screed is formed by constructing a continuous mound between two or more points upon which the leveling stick has been placed. This continuous mound, which becomes the pre-set screed, is of the same height as the leveling stick placed atop the points, thus making the continuous mound or pre-set screed level with the two or more points.

The best method for forming the pre-set screeds or continuous mound is the same as has previously been mentioned with the method for forming the said points, namely, the mix which is to form the said screed, is placed in the area in which the pre-set screed is to be formed, said mix to be laid somewhat above the determined height of the pre-set screed. When the said mix starts to set, at the moment judged suitable by the controller of the said pre-set screeds, the leveling stick is placed atop two or more points to establish the proper height of the pre-set screed. The said screed can then be padded into the proper height, which said padding will result in the mound which is the pre-set screed, whose cross-section then equals a trapezoid ridge which is the screeds.

The said pre-set screen/s so constructed will then be suitable for use when cement, concrete, or other similar types of material is poured between any two of them. It has been determined that by vibrating the cement, concrete or other similar types of material between the screeds, with either a vibrator or a vibrating motion when the materials are poured, the mixture is best packed so as to avoid the mixture's shrinking along the top of the previously hardened pre-set screeds as the poured mixture hardens.

If slight irregularities in smoothness of surface occur in the newly poured module at the sector where the said module mates with the pre-set screeds, then sanding is used to perfect the total module, or an epoxy or other type filler is used to eliminate the said irregularities, or a combination of these methods may be employed.

The use of this process for developing surfaces makes it possible to surface or resurface a sound surface, but it is understood that all of part of this method can be used to construct any type of module or platform with any grading. For example, by using only the points described herein on top of an existing sound surface, and then by placing a carrying beam atop one, two, or more of the said points, it is possible to construct a deck.

This process for developing surfaces can also be used on sound ground with no existing surface, so as to lay a surface of cement, concrete, or other similar types of material, on the said sound ground.

Prior to when a new surface is constructed on top of an existing slab, it may be found that either the mounds which form the points or the said pre-set screeds, do not adhere to the existing module as strongly as desired. In these cases, a binding material and/or agent is used to improve the cohesiveness of the points or screeds and of the new module with the existing module.

Though it is obvious to those skilled in the art that this process for developing surfaces has an advantage in that the points and screeds eventually become part of the permanent module which is laid, it is herein stated that this is one of the innovations of this new process—that the pre-set screeds and points do not have to be removed, but rather become imbedded into and form a part of, the permanent module being laid. It is understood that reinforcing mesh or rods may be inserted into this process, either prior to all formations or prior to any formations preceding the pouring of the module.

Although but a single embodiment of the process has been illustrated and described, it is apparent to those skilled in the art, that various changes and modifications can be made therein without departing from the spirit of the invented process or from the scope of the appended claims.

I claim:

1. A process for developing a surface covering of settable material to a level having a uniform elevation, said settable material being applied to an existing sound surface, said process comprising:

a. arrangement of pre-set points in pre-determined places on said existing sound surface;

b. determination of the height of said pre-set points by means of an instrument;

c. formation of said pre-set points of said settable material which sets to said pre-determined heights;

d. construction of screed means along the said points, said screed means to be constructed to the same height as the surface and points;

e. the pouring of a layer of material which sets between the pre-set screed means and points and leveling the newly poured material to the height of the pre-set screeds, so that the screeds become part of the newly poured material which forms a surfacing module.

2. The process of claim 1, wherein the screed means are made of the same material as the points, said screed means enveloping the points which then become part of the screed means.

3. The process of claim 1 where said surface covering has reinforcement emplaced prior to pouring the material which sets.

* * * * *